US007652546B2

(12) United States Patent
Hersey et al.

(10) Patent No.: US 7,652,546 B2
(45) Date of Patent: Jan. 26, 2010

(54) FERROELECTRIC VARACTORS SUITABLE FOR CAPACITIVE SHUNT SWITCHING

(75) Inventors: Ken Hersey, Clarksville, MD (US); Khosro Shamsaifar, Ellicott City, MD (US); Louise C. Sengupta, Ellicott City, MD (US)

(73) Assignee: Paratek Microwave, Inc., Columbia, MD (US)

( * ) Notice: Subject to any disclaimer, the term of this patent is extended or adjusted under 35 U.S.C. 154(b) by 21 days.

(21) Appl. No.: 11/494,066

(22) Filed: Jul. 27, 2006

(65) Prior Publication Data

US 2007/0013466 A1 Jan. 18, 2007

Related U.S. Application Data

(63) Continuation of application No. 11/045,957, filed on Jan. 28, 2005, now Pat. No. 7,268,643.

(60) Provisional application No. 60/539,771, filed on Jan. 28, 2004.

(51) Int. Cl.
*H01P 1/10* (2006.01)

(52) U.S. Cl. ..... 333/101; 333/262

(58) Field of Classification Search ..... 333/101, 333/262

See application file for complete search history.

(56) References Cited

U.S. PATENT DOCUMENTS

| | | | | |
|---|---|---|---|---|
| 5,061,941 | A | 10/1991 | Lizzi et al. | 343/742 |
| 5,312,790 | A | 5/1994 | Sengupta et al. | 501/137 |
| 5,427,988 | A | 6/1995 | Sengupta et al. | 501/137 |
| 5,486,491 | A | 1/1996 | Sengupta et al. | 501/137 |
| 5,593,495 | A | 1/1997 | Masuda et al. | 117/4 |
| 5,635,433 | A | 6/1997 | Sengupta | 501/137 |
| 5,635,434 | A | 6/1997 | Sengupta | 501/138 |
| 5,640,042 | A | 6/1997 | Koscica et al. | 257/595 |
| 5,693,429 | A | 12/1997 | Sengupta et al. | 428/699 |
| 5,694,134 | A | 12/1997 | Barnes | 343/700 |
| 5,766,697 | A | 6/1998 | Sengupta et al. | 427/585 |
| 5,830,591 | A | 11/1998 | Sengupta et al. | 428/701 |
| 5,846,893 | A | 12/1998 | Sengupta et al. | 501/137 |
| 5,886,867 | A | 3/1999 | Chivukula et al. | 361/311 |
| 5,990,766 | A | 11/1999 | Zhang et al. | 333/205 |

(Continued)

FOREIGN PATENT DOCUMENTS

WO WO 2005043669 * 5/2005

OTHER PUBLICATIONS

Kuylenstierna et al "Tunable Electromagnetic Bandgap Structure based on Ferroelectric films" Jun. 2003, Antenna and propagation Society Int. Sym IEEE, 22-27 pp. 879-882.*

(Continued)

*Primary Examiner*—Benny Lee
*Assistant Examiner*—Kimberly E Glenn
(74) *Attorney, Agent, or Firm*—James Finn; Ed Guntin; Andrew Gust

(57) ABSTRACT

An embodiment of the present invention provides an apparatus, comprising a radio frequency switch capable of using tunable dielectric capacitors as the switching element for a plurality of cross connected ports. Further, the RF switching may be accomplished by creating an RF short at a tee within said apparatus by the combination of transmission lines and the impedance provided by the tunable dielectric capacitor.

14 Claims, 4 Drawing Sheets

U.S. PATENT DOCUMENTS

| | | | | |
|---|---|---|---|---|
| 6,074,971 | A | 6/2000 | Chiu et al. | 501/139 |
| 6,377,142 | B1 | 4/2002 | Chiu et al. | 333/238 |
| 6,377,217 | B1 | 4/2002 | Zhu et al. | 343/700 |
| 6,377,440 | B1 | 4/2002 | Zhu et al. | 361/311 |
| 6,404,614 | B1 * | 6/2002 | Zhu et al. | 361/277 |
| 6,454,914 | B1 * | 9/2002 | Nakamura | 204/192.17 |
| 6,492,883 | B2 | 12/2002 | Liang et al. | 333/132 |
| 6,514,895 | B1 | 2/2003 | Chiu et al. | 501/137 |
| 6,525,630 | B1 | 2/2003 | Zhu et al. | 333/205 |
| 6,531,936 | B1 | 3/2003 | Chiu et al. | 333/164 |
| 6,535,076 | B2 | 3/2003 | Partridge et al. | 333/17.1 |
| 6,538,603 | B1 | 3/2003 | Chen et al. | 342/372 |
| 6,556,102 | B1 | 4/2003 | Sengupta et al. | 333/161 |
| 6,590,468 | B2 | 7/2003 | du Toit et al. | 333/173 |
| 6,597,265 | B2 | 7/2003 | Liang et al. | 333/204 |
| 6,646,522 | B1 * | 11/2003 | Kozyrev et al. | 333/161 |
| 6,741,207 | B1 * | 5/2004 | Allison et al. | 342/371 |
| 6,855,992 | B2 * | 2/2005 | Emrick et al. | 257/378 |
| 7,030,463 | B1 * | 4/2006 | Subramanyam et al. | 257/595 |
| 7,268,643 | B2 * | 9/2007 | Hersey et al. | 333/101 |

OTHER PUBLICATIONS

Subramanyam et al. WO 2005 043669.

* cited by examiner

FERROELECTRIC VARACTORS SUITABLE FOR CAPACITIVE SHUNT SWITCHING

CROSS-REFERENCE TO RELATED APPLICATION

This application is a continuation of U.S. patent application 11 045,957, filed Jan. 28, 2005 now U.S. Pat. No. 7,268,643, entitled APPARATUS, SYSTEM AND METHOD CAPABLE OF RADIO FREQUENCY SWITCHING USING TUNABLE DIELECTRIC CAPACITORS, to Hersey et al. which claimed the benefit of priority under 35 U.S.C. Section 119 from U.S. Provisional Application Ser. No. 60/539,771, filed Jan. 28, 2004, entitled "RF Switch Using Tunable Dielectric Capacitors" by Hersey et al.

BACKGROUND OF THE INVENTION

RF and microwave switches have widespread applications in microwave systems. They typically may use semiconductor active devices as the switching element. Semiconductor switches, however, cannot be used for applications that require high power handling as they will generate unwanted harmonics and distortions in the signal due to intermodulation effects. Although there are semiconductor RF switches that can handle up to several watts, they usually suffer from high insertion loss. An alternative may be to use mechanical switches with very high power handling, but those switches are bulky, heavy and consume a lot of power.

Therefore, there is a need for small, low loss, and linear RF switches that may be used in a wide range of RF and microwave frequencies, with high power handling capability.

SUMMARY OF THE INVENTION

An embodiment of the present invention provides an apparatus, comprising a radio frequency switch capable of using tunable dielectric capacitors as the switching element. The apparatus may further comprise a cross connector a plurality of ports and wherein at least one of the tunable dielectric capacitors may be placed between the cross connector and at least one port, thereby enabling impedance variations between the cross connector and the ports. Further, an embodiment of the present invention may provide at least one Tee connector between the cross connector and at least one of the plurality of ports, wherein at least one tunable dielectric capacitor may be associated with the Tee connector to vary the impedance in at least one node of the Tee connector.

Another embodiment of the present invention provides an apparatus, comprising an On-Off switch including a first port and a second port separated by a stop band filter, wherein at least one tunable dielectric capacitor may be integrated between the first port and the stop band filter and between the second port and the stop band filter. This embodiment may further comprise at least one additional port separated by the first and second ports by the stop band filter and at least one additional tunable dielectric capacitor between the at least one additional port and the stop band filter. A voltage source may facilitate the tunability of the tunable dielectric capacitors.

In yet another embodiment of the present invention is provided a method of switching radio frequency RF signals, comprising using tunable dielectric capacitors as the switching element for an RF switch. This method may further comprise connecting a plurality of ports with a cross connector in the RF switch and enabling impedance variations between the cross connector and the ports by at least one of the tunable dielectric capacitors placed between the cross connector at and least one port. The method may further comprise placing at least one T connector between the cross connector and at least one of the plurality of ports, wherein at least one tunable dielectric capacitor is associated with the T connector to vary the impedance in at least one node of the T connector.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DESCRIPTION OF THE PREFERRED EMBODIMENT

Figure 1:
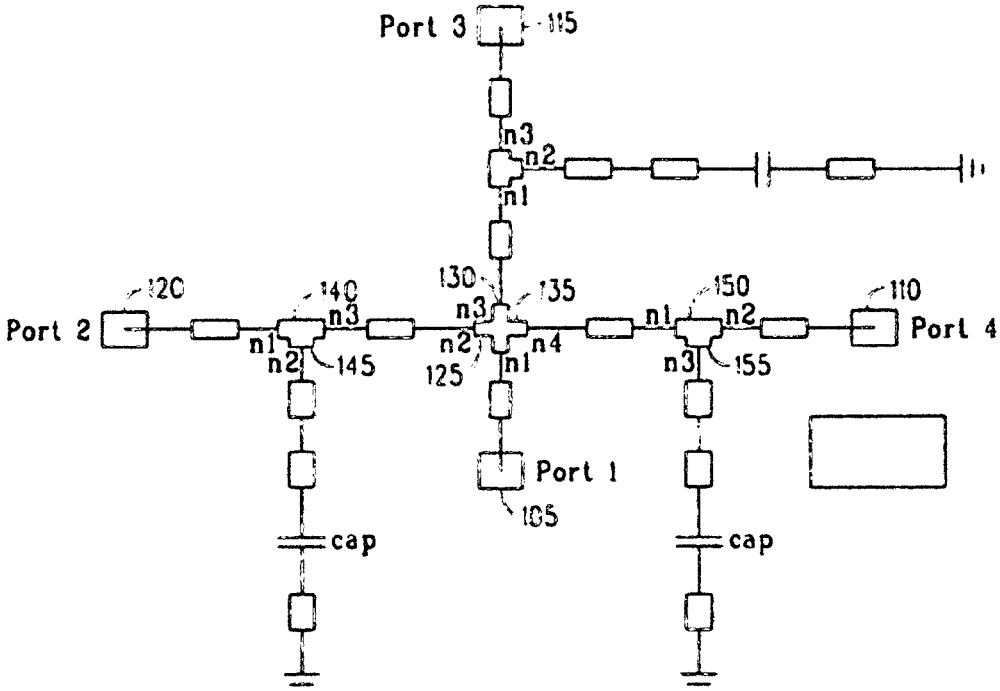
FIG. 1 illustrates a schematic of an exemplary switch using tunable capacitors of one embodiment of the present invention.

An embodiment of the present invention provides a switch topology that may be based on Parascan® tunable material. Parascan® is a family of tunable dielectric material with excellent RF and microwave properties, such as, high Q, fast tuning, and high IP3. Further, the term Parascan® as used herein is a trademarked word indicating a tunable dielectric material developed by the assignee of the present invention. Parascan® tunable dielectric materials have been described in several patents. Barium strontium titanate ($BaTiO_3$—$SrTiO_3$), also referred to as BSTO, is used for its high dielectric constant (200-6,000) and large change in dielectric constant with applied voltage (25-75 percent with a field of 2 Volts micron). Tunable dielectric materials including barium strontium titanate are disclosed in U.S. Pat. No. 5,312,790 to Sengupta, et al. entitled "Ceramic Ferroelectric Material"; U.S. Pat. No. 5,427,988 by Sengupta, et al. entitled "Ceramic Ferroelectric Composite Material-BSTO-MgO"; U.S. Pat. No. 5,486,491 to Sengupta, et al. entitled "Ceramic Ferroelectric Composite Material-BSTO-$ZrO_2$"; U.S. Pat. No. 5,635,434 by Sengupta, et al. entitled "Ceramic Ferroelectric Composite Material-BSTO-Magnesium Based Compound"; U.S. Pat. No. 5,830,591 by Sengupta, et al. entitled "Multilayered Ferroelectric Composite Waveguides"; U.S. Pat. No. 5,846,893 by Sengupta, et al. entitled "Thin Film Ferroelectric Composites and Method of Making"; U.S. Pat. No. 5,766, 697 by Sengupta, et al. entitled "Method of Making Thin Film Composites"; U.S. Pat. No. 5,693,429 by Sengupta, et al. entitled "Electronically Graded Multilayer Ferroelectric Composites"; U.S. Pat. No. 5,635,433 by Sengupta entitled "Ceramic Ferroelectric Composite Material BSTO-ZnO"; U.S. Pat. No. 6,074,971 by Chiu et al. entitled "Ceramic Ferroelectric Composite Materials with Enhanced Electronic Properties BSTO-Mg Based Compound-Rare Earth Oxide". These patents are incorporated herein by reference. The materials shown in these patents, especially BSTO-MgO composites, show low dielectric loss and high tunability. Tunability is defined as the fractional change in the dielectric constant with applied voltage.

Barium strontium titanate of the formula $Ba_xSr_{2-x}TiO_3$ is a preferred electronically tunable dielectric material due to its favorable tuning characteristics, low Curie temperatures and low microwave loss properties. In the formula $Ba_xSr_{1-x}TiO_3$ x can be any value from 0 to 1, preferably from about 0.15 to about 0.6. More preferably, x is from 0.3 to 0.6.

Other electronically tunable dielectric materials may be used partially or entirely in place of barium strontium titanate. An example is $Ba_xCa_{1-x}TiO_3$, where x is in a range from about 0.2 to about 0.8, preferably from about 0.4 to about 0.6. Additional electronically tunable ferroelectrics include $Pb_xZr_{1-x}TiO_3$ (PZT) where x ranges from about 0.0 to about 1.0, $Pb_xZr_{1-x}SrTiO_3$ where x ranges from about 0.05 to about 0.4, $KTa_xNb_{1-x}O_3$ where x ranges from about 0.0 to about 1.0, lead lanthanum zirconium titanate (PLZT), $PbTiO_3$, $BaCaZrTiO_3$, $NaNO_3$, $KNbO_3$, $LiNbO_3$, $LiTaO_3$, $PbNb_2O_6$, $PbTa_2O_6$, $KSr(NbO_3)$ and $NaBa_2(NbO_3)_5KH_2PO_4$, and mixtures and compositions thereof. Also, these materials can be combined with low loss dielectric materials, such as magnesium oxide (MgO), aluminum oxide ($Al_2O_3$), and zirconium oxide ($ZrO_2$), and/or with additional doping elements, such as manganese (MN), iron (Fe), and tungsten (W), or with other alkali earth metal oxides (i.e. calcium oxide, etc.), transition metal oxides, silicates, niobates, tantalates, aluminates, zirconates, and titanates to further reduce the dielectric loss.

In addition, the following U.S. Patent Applications, assigned to the assignee of this application, disclose additional examples of tunable dielectric materials: U.S. application Ser. No. 09/594,837 filed Jun. 15, 2000, entitled "Electronically Tunable Ceramic Materials Including Tunable Dielectric and Metal Silicate Phases"; U.S. application Ser. No. 09/768,690 filed Jan. 24, 2001, entitled "Electronically Tunable, Low-Loss Ceramic Materials Including a Tunable Dielectric Phase and Multiple Metal Oxide Phases"; U.S. application Ser. No. 09/882,605 filed Jun. 15, 2001, entitled "Electronically Tunable Dielectric Composite Thick Films And Methods Of Making Same"; U.S. application Ser. No. 09 834,327 filed Apr. 13, 2001, entitled "Strain-Relieved Tunable Dielectric Thin Films"; and U.S. Provisional Application Ser. No. 60 295,046 filed Jun. 1, 2001 entitled "Tunable Dielectric Compositions Including Low Loss Glass Frits". These patent applications are incorporated herein by reference.

The tunable dielectric materials can also be combined with one or more non-tunable dielectric materials. The non-tunable phase(s) may include MgO, $MgAl_2O_4$, $MgTiO_3$, $Mg_2SiO_4$, $CaSiO_3$, $MgSrZrTiO_6$, $CaTiO_3$, $Al_2O_3$, $SiO_2$ and/or other metal silicates such as $BaSiO_3$ and $SrSiO_3$. The non-tunable dielectric phases may be any combination of the above, e.g., MgO combined with $MgTiO_3$, MgO combined with $MgSrZrTiO_6$, MgO combined with $Mg_2SiO_4$, MgO combined with $Mg_2SiO_4$, $Mg_2SiO_4$ combined with $CaTiO_3$ and the like.

Additional minor additives in amounts of from about 0.1 to about 5 weight percent can be added to the composites to additionally improve the electronic properties of the films. These minor additives include oxides such as zirconnates, tannates, rare earths, niobates and tantalates. For example, the minor additives may include $CaZrO_3$, $BaZrO_3$, $SrZrO_3$, $BaSnO_3$, $CaSnO_3$, $MgSnO_3$, $Bi_2O_32SnO_2$, $Nd_2O_3$, Pr—$O_{t1}$, $Yb_2O_3$, $Ho_2O_3$, $La_2O_3$, $MgNb_2O_6$, $SrNb_2O_6$, $BaNb_2O_6$, $MgTa_2O_6$, $BaTa_2O_6$ and $Ta_2O_3$.

Thick films of tunable dielectric composites can comprise $Ba_{1-x}Sr_xTiO_3$, where x is from 0.3 to 0.7 in combination with at least one non-tunable dielectric phase selected from MgO, $MgTiO_3$, $MgZrO_3$, $MgSrZrTiO_6$, $Mg_2SiO_4$, $CaSiO_3$, $MgAl_2O_4$, $CaTiO_3$, $Al_2O_3$, $SiO_2$, $BaSiO_3$ and $SrSiO_3$. These compositions can be BSTO and one of these components, or two or more of these components in quantities from 0.25 weight percent to 80 weight percent with BSTO weight ratios of 99.75 weight percent to 20 weight percent.

The electronically tunable materials can also include at least one metal silicate phase. The metal silicates may include metals from Group 2A of the Periodic Table, i.e., Be, Mg, Ca, Sr, Ba and Ra, preferably Mg, Ca, Sr and Ba. Preferred metal silicates include $Mg_2SiO_4$, $CaSiO_3$, $BaSiO_3$ and $SrSiO_3$. In addition to Group 2A metals, the present metal silicates may include metals from Group 1A, i.e., Li, Na, K, Rb, Cs and Fr, preferably Li, Na and K. For example, such metal silicates may include sodium silicates such as $Na_2SiO_3$ and $NaSiO_3$—$5H_2O$, and lithium-containing silicates such as $LiAlSiO_4$, $Li_2SiO_3$ and $Li_4SiO_4$. Metals from Groups 3A, 4A and some transition metals of the Periodic Table may also be suitable constituents of the metal silicate phase. Additional metal silicates may include $Al_2Si_2O_7$, $ZrSiO_4$, $KalSi_3O_8$, $NaAlSi_3O_8$, $CaAl_2Si_2O_8$, $CaMgSi_2O_6$, $BaTiSi_3O_9$ and $Zn_2SiO_4$. The above tunable materials can be tuned at room temperature by controlling an electric field that is applied across the materials.

In addition to the electronically tunable dielectric phase, the electronically tunable materials can include at least two additional metal oxide phases. The additional metal oxides may include metals from Group 2A of the Periodic Table, i.e., Mg, Ca, Sr, Ba, Be and Ra, preferably Mg, Ca, Sr and Ba. The additional metal oxides may also include metals from Group 1A, i.e., Li, Na, K, Rb, Cs and Fr, preferably Li, Na and K. Metals from other Groups of the Periodic Table may also be suitable constituents of the metal oxide phases. For example, refractory metals such as Ti, V, Cr, Mn, Zr, Nb, Mo, Hf, Ta and W may be used. Furthermore, metals such as Al, Si, Sn, Pb and Bi may be used. In addition, the metal oxide phases may comprise rare earth metals such as Sc, Y, La, Ce, Pr, Nd and the like.

The additional metal oxides may include, for example, zirconnates, silicates, titanates, aluminates, stannates, niobates, tantalates and rare earth oxides. Preferred additional metal oxides include $Mg_2SiO_4$, MgO, $CaTiO_3$, $MgZrSrTiO_6$, $MgTiO_3$, $MgAl_2O_4$, $WO_3$, $SnTiO_4$, $ZrTiO_4$, $CaSiO_3$, $CaSnO_3$, $CaWO_4$, $CaZrO_3$, $MgTa_2O_6$, $MgZrO_3$, $MnO_2$, PbO, $Bi_2O_3$ and $La_2O_3$. Particularly preferred additional metal oxides include $Mg_2SiO_4$, MgO, $CaTiO_3$, $MgZrSrTiO_6$, $MgTiO_3$, $MgAl_2O_4$, $MgTa_2O_6$ and $MgZrO_3$.

The additional metal oxide phases are typically present in total amounts of from about 1 to about 80 weight percent of the material, preferably from about 3 to about 65 weight percent, and more preferably from about 5 to about 60 weight percent. In one preferred embodiment, the additional metal oxides comprise from about 10 to about 50 total weight percent of the material. The individual amount of each additional metal oxide may be adjusted to provide the desired properties.

Where two additional metal oxides are used, their weight ratios may vary, for example, from about 1:100 to about 100:1, typically from about 1:10 to about 10:1 or from about 1:5 to about 5:1. Although metal oxides in total amounts of from 1 to 80 weight percent are typically used, smaller additive amounts of from 0.01 to 1 weight percent may be used for some applications.

The additional metal oxide phases can include at least two Mg-containing compounds. In addition to the multiple Mg-containing compounds, the material may optionally include Mg-free compounds, for example, oxides of metals selected from Si, Ca, Zr, Ti, Al and or rare earths.

Turning to FIG. 1, illustrated generally as 100, is a schematic of one embodiment of the present invention of an SP3I switch that may use a tunable dielectric capacitor as the switching elements. Although not limited in this respect, an embodiment of the present invention provides the radio frequency (RF) signal is input at port 1 105, the active port is port number 4 110, and the other two ports (port 3, 114 and port 2, 120) may be isolated. To achieve this, the impedances looking at nodes n2 125 and n3 130 of the Cross 135, should show an RF open. In this way all the signal input at port 1, 105 will be available at port 4, 110 except for small insertion loss. To achieve an RF open at node n2 125 of the cross 135 there must be an RF short at node n2 125 of the tee 140 in the path to port 2 120 as well as λ/4 of transmission line between n2 125 of Cross 135 and n2 125 of Tee 140 junction.

The RF short at n3 145 of the tee 140 is achieved by the combination of the transmission lines shown in FIG. 1 and the impedance provided by a variable capacitor made of tunable dielectric material. Similar operation may occur in the path to port 3 115 of the switch 100. The operation of the active path is different from the isolated paths in that the impedance seen at node 3 155 of the tee 150 junction is an RF open. This way, all of the RF signal present at the cross 135 will reach port 4 110, except for minor insertion loss.

Figure 2:
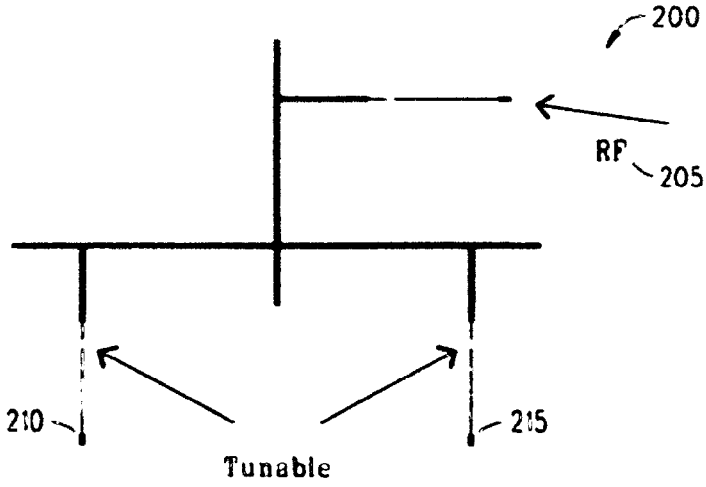
FIG. 2 shows one layout of an exemplary switch using tunable capacitors of one embodiment of the present invention.

Turning now to FIG. 2, shown generally as 200, is a layout of an SP3I switch using tunable capacitors in one embodiment of the present invention. It is understood that there are numerous possible circuit configurations and types of switches and these are provided merely for illustrative purposes. As shown, the tunable capacitors 210 and 215 may be placed in the gaps shown. RF input is shown at 205 with the DC bias circuit not shown.

Figure 3:
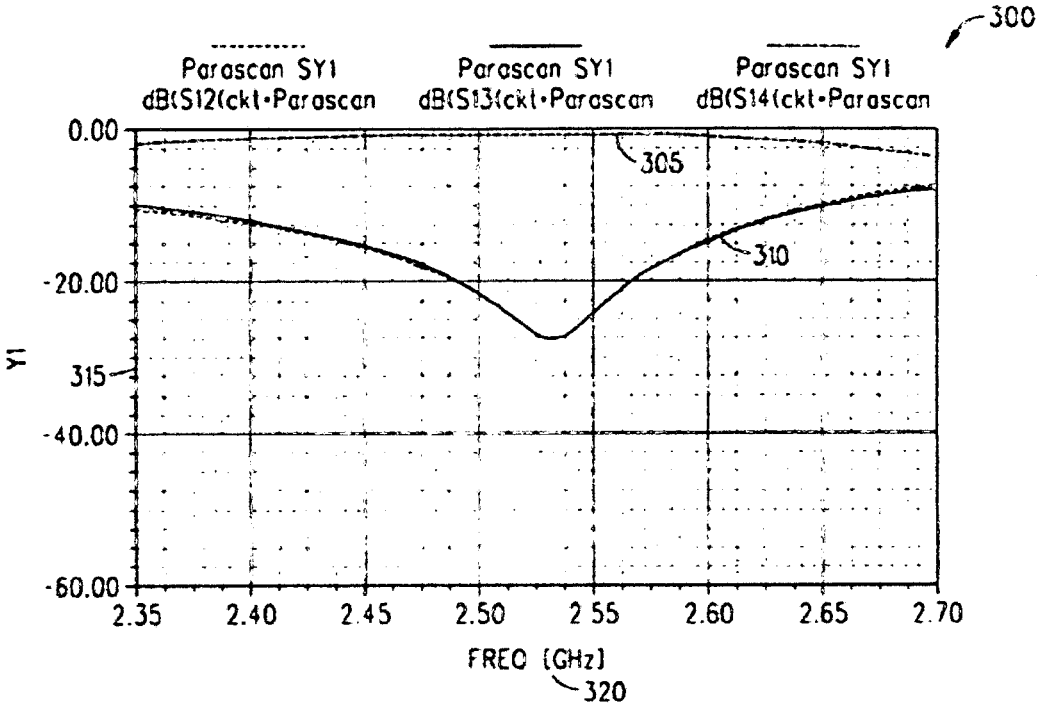
FIG. 3 graphically depicts the response of an exemplary switch with port 4 active of one embodiment of the present invention.

Turning now to FIG. 3, generally at 300 is illustrated S-parameters 305 and 310 in Frequency 320 vs. dB 315 of a switch of one embodiment of the present invention with port 4 active. As illustrated in FIG. 3, the isolation of the non-active ports is better than 20 dB over approximately 70 MHz of the band.

Figure 4:
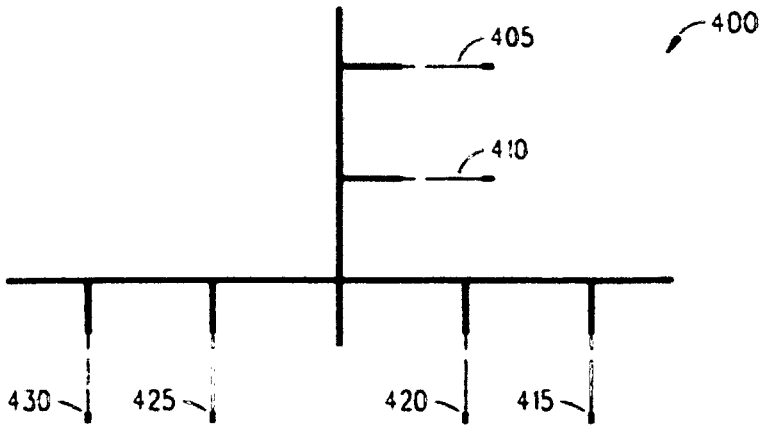
FIG. 4 depicts the layout of an exemplary switch using tunable capacitors with high isolation of one embodiment of the present invention.
Figure 5:
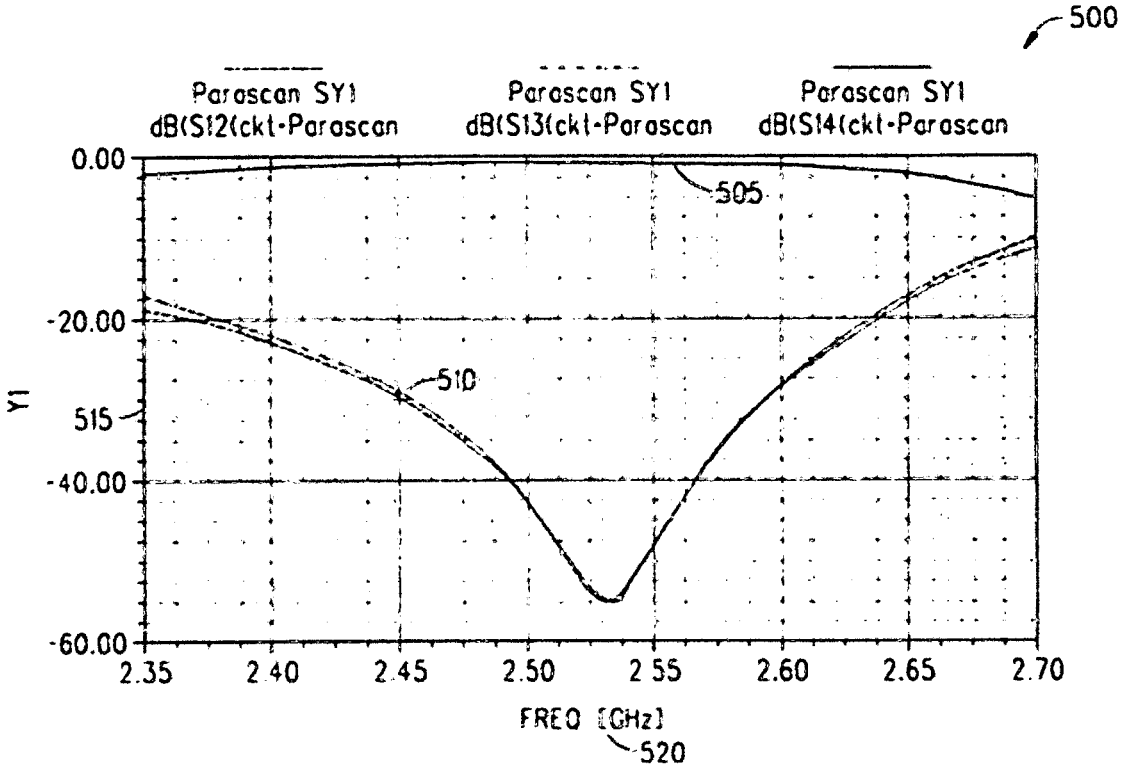
FIG. 5 graphically depicts the response of a high isolation switch with port 4 active of one embodiment of the present invention.

In another embodiment of the present invention as shown in FIG. 4, generally as 400, is a layout of an SP3T switch using tunable capacitors with high isolation which include two parallel switching sections 402 and 404; 406 and 408; 412 and 414, which may be used in each path of the 3-way switch. Tunable capacitors are illustrated at 405, 410, 415, 420, 425 and 430 however, it is understood that any number of tunable capacitors in many different configurations are within the scope of the present invention. By integrating the tunable capacitors of FIG. 4, the isolation of the inactive paths will be increased. This is shown in FIG. 5 at 500 in Frequency 420 vs. dB 515 at 505 and 515 where it can be observed that the isolation of more than 40 dB is achieved over similar bandwidth.

Figure 6:
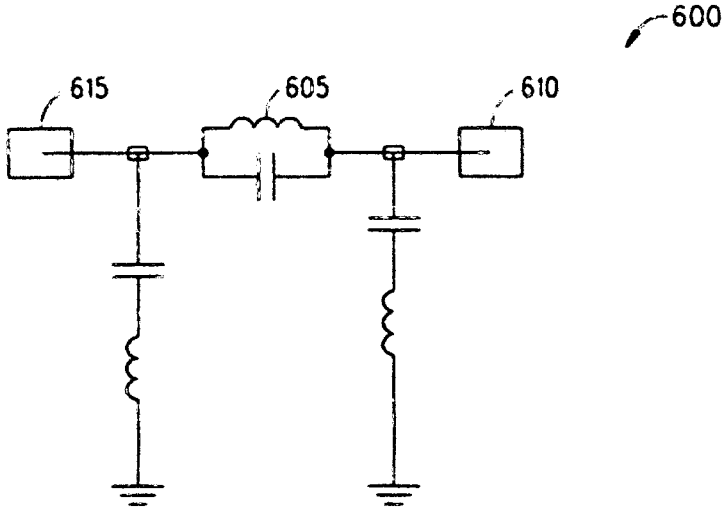
FIG. 6 depicts a schematic of an On-Off switch with tunable capacitors of one embodiment of the present invention.
Figure 7:
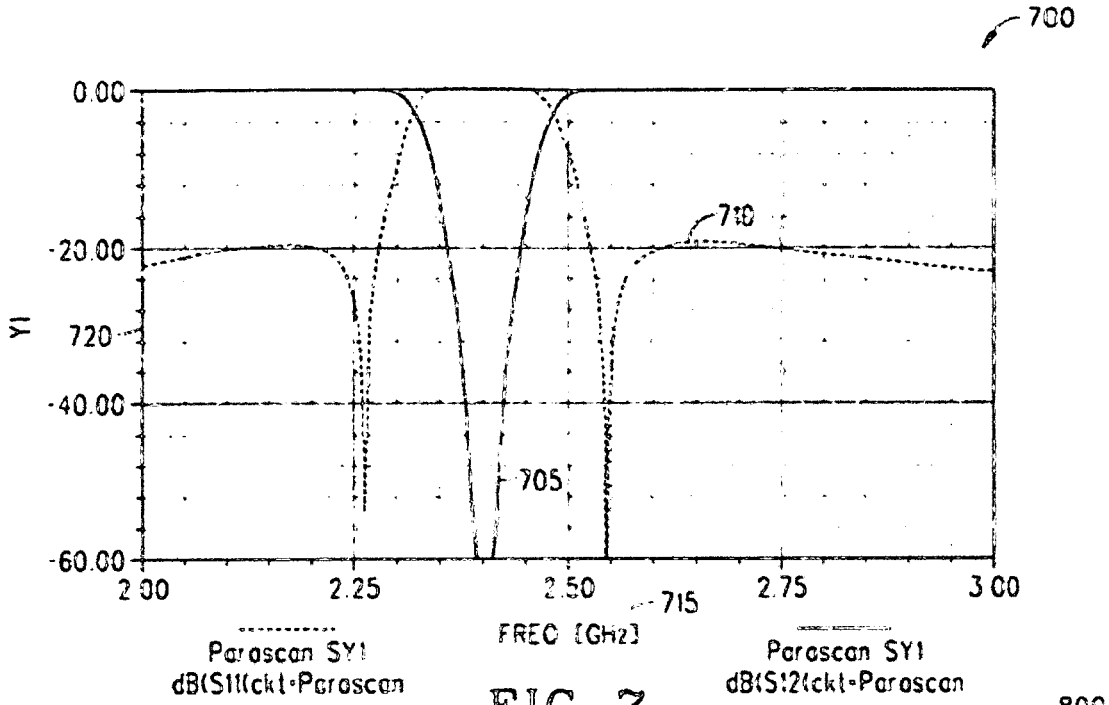
FIG. 7 graphically illustrates the response of an On-Off switch in off the position in one embodiment of the present invention.

Turning now to FIG. 6 is a schematic of an On-Off switch 600 with at least one tunable capacitor. Parascan® tunable material may be used to facilitate an On-Off switch 600. Although not limited in this respect, FIG. 6 illustrates a stop band filter topology with port 1 615 and port 2 610, wherein at certain values of tuning capacitors, the stop band filter 605 will resonate and therefore isolate port 1 615 from port 2 (Off condition) 610. This condition is shown in FIG. 7 at 700 in Frequency (GHz) 715 vs dB 720. It is observed that the frequencies around 2.4 GHz will be isolated by about 30 dB with a bandwidth of 50 MHz as shown by the trace depicted at 705 contrasted by the trace at 710.

Figure 8:
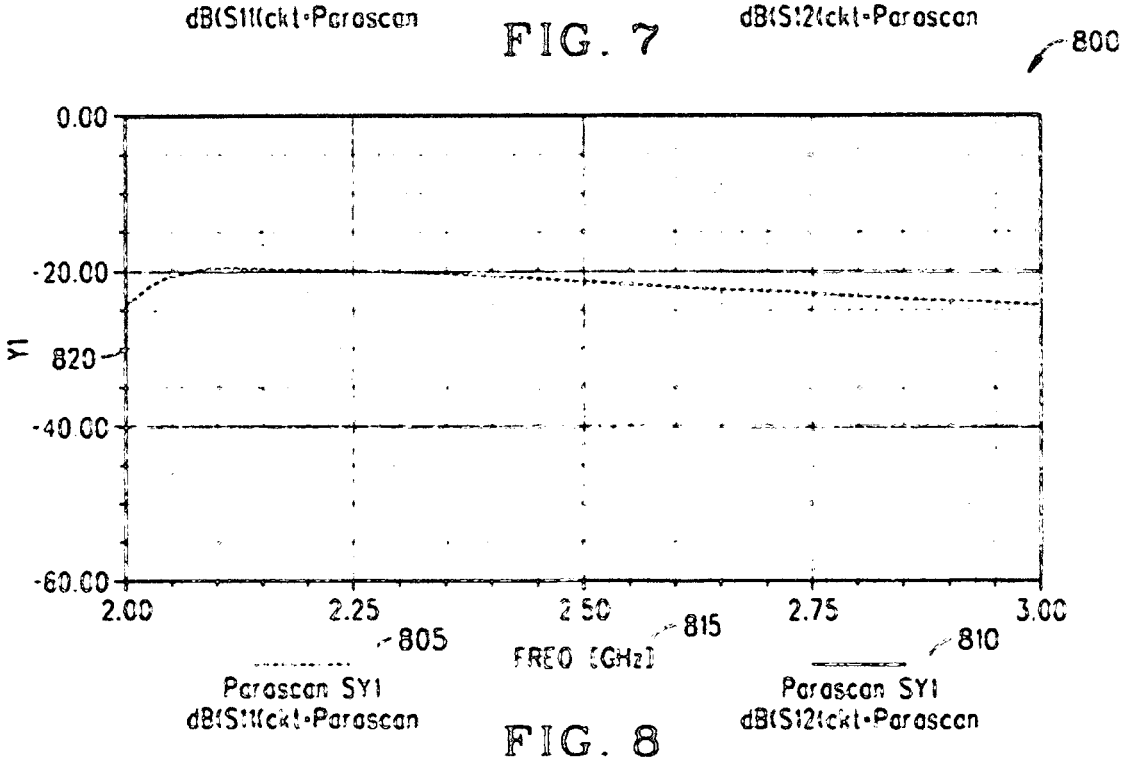
FIG. 8 graphically illustrates the response of On-Off switch in the "On" position in one embodiment of the present invention.

In an embodiment of the present invention, in the "On" condition, the capacitors may be tuned to different values by changing the bias voltage, and the stop band filter may no longer work as such. Although not limited in this respect, this condition may be achieved typically by a 2:1 capacitance tuning. FIG. 8 at 800, shows the response in frequency (GHz) 815 vs dB 820. As observed in the traces 805 and 815, all of the RF signal may pass through the circuit with minimum insertion loss and better than 20 dB return loss over a wide band.

While certain features of the invention have been illustrated and described herein, many modifications, substitutions, changes, and equivalents will now occur to those skilled in the art. It is, therefore, to be understood that the appended claims are intended to cover all such modifications and changes as fall within the true spirit of the invention.

What is claimed is:

1. An apparatus, comprising:

a radio frequency switch capable of using tunable dielectric capacitors as a switching element for a plurality of cross connected ports;

wherein RF switching is accomplished by creating an RF short at a tee within said apparatus by a combination of transmission lines and an impedance provided by at least one of said tunable dielectric capacitors.

2. The apparatus of claim 1, wherein at least one of said tunable dielectric capacitors is placed between a cross connector and least one of the plurality of cross connected ports, thereby enabling impedance variation between said cross connector and said least one of the plurality of cross connected ports.

3. The apparatus of claim 2, further comprising at least one tee connector between said cross connector and at least one of said plurality of ports, wherein at least one of the tunable dielectric capacitors is associated with said at least one tee connector to vary the impedance in at least one node of said at least one tee connector.

4. The apparatus of claim 3, wherein said at least one tunable dielectric capacitor associated with said at least one tee connector is associated by using a plurality parallel switching sections in paths.

5. The apparatus of claim 4, wherein said plurality of parallel switching sections is two parallel switching sections.

6. The apparatus of claim 2, wherein said impedance variation enables RF signal control to any of said least one of the plurality of cross connected ports.

7. An RF Switch, comprising:

an input port;

a plurality of output ports; and wherein said RF switch switches between said plurality of output ports by creating an RF short at a tee within said RF switch by a combination of transmission lines and an impedance provided by at least one tunable dielectric capacitor.

8. The RF Switch of claim 7, further comprising a cross connector connecting said plurality of output ports.

9. The RF Switch of claim 8, further comprising and at least one tee connector between said cross connector and at least one of said plurality of output ports, wherein said at least one tunable dielectric capacitor is associated with said at least one tee connector to vary the impedance in at least one node of said tee connector.

10. The RF Switch of claim 9, wherein said impedance being varied enables RF signal control to any of said plurality of output ports.

11. The RF Switch of claim 9, wherein said at least one tunable dielectric capacitor associated with said at least one tee connector is associated by using a plurality parallel switching sections in paths.

12. The RF Switch of claim 11, wherein said plurality of parallel switching sections is two parallel switching sections.

13. A method, comprising:

increasing isolation of inactive paths in a multi-way switch by using a plurality of parallel switching sections in each of said inactive paths of the multi-way switch, said parallel switching sections including tunable capacitors capable of high isolation by varying control voltages to said tunable capacitors.

14. The method of claim 13, wherein said multi-way switch is a three-way switch and said plurality of parallel switching sections is two parallel switching sections in each of said inactive paths of said three-way switch.

* * * * *